United States Patent [19]

Scott

[11] 3,955,498

[45] May 11, 1976

[54] ELECTROMAGNETICALLY ACTUATED PRINTER

[76] Inventor: Thaddeus LeRoy Scott, 360 Hyde Drive, Hayward, Calif. 94544

[22] Filed: Mar. 27, 1975

[21] Appl. No.: 562,633

[52] U.S. Cl. ..... 101/93.31; 101/368

[51] Int. Cl.[2] ..... B41J 7/32; B41K 1/08

[58] Field of Search ..... 197/98, 53; 101/93.3, 101/93.31, 93.32, 93.33, 93.34, 93.28, 93.29; 200/61.19, 153 M; 335/165, 186

[56] References Cited

UNITED STATES PATENTS

| | | | |
|---|---|---|---|
| 3,139,820 | 7/1964 | Kittler | 101/93.31 |
| 3,382,338 | 5/1968 | Arseneault et al. | 197/98 X |
| 3,494,550 | 2/1970 | Hayes et al. | 197/98 X |
| 3,584,162 | 6/1971 | Krakinowski | 197/98 X |
| 3,693,775 | 9/1972 | Brooks et al. | 197/98 |
| 3,696,408 | 10/1972 | Bouchard | 197/98 X |
| 3,725,907 | 4/1973 | Boulanger | 197/98 X |
| 3,747,090 | 7/1973 | Englund et al. | 197/98 |
| 3,797,630 | 3/1974 | Zilkha | 197/98 |
| 3,842,956 | 10/1974 | Reilly et al. | 197/6.4 |
| 3,842,960 | 10/1974 | Gerry | 197/53 |

OTHER PUBLICATIONS

IBM Tech. Bull. "Keyboard", Dirks, Vol. 12, No. 7, Dec. 1969, p. 982.

*Primary Examiner*—Edgar S. Burr
*Assistant Examiner*—Paul J. Hirsch
*Attorney, Agent, or Firm*—Harris Zimmerman

[57] ABSTRACT

A device for printing in association with hand-held calculators comprises a pair of vertically stacked blocks joined by a elastomer layer, the lower block formed of elastic material. Vertically embedded in the lower block is an array of digit forming segments, each having a raised central portion extending above the upper surface of the lower block. Embedded in the upper block is an array of needle electromagnets, each aligned with a digit segment. Interposed between each electromagnet and its associated digit segment is a sloping channel in which a small ferromagnetic actuator is slidably disposed. Selective actuation of the electromagnets latches the actuators in position to transmit force from the upper block to the raised central portion of the respective digit segment. As the blocks are manually forced downward toward the printing plane a lever device tilts the blocks to allow unlatched actuators to slide out of force transmitting position. The remaining actuators force their segments to protrude from the lower surface of the lower block, striking the printing surface and producing the correct digital record.

5 Claims, 5 Drawing Figures

ELECTROMAGNETICALLY ACTUATED PRINTER

BACKGROUND OF THE INVENTION

In recent years hand-held calculators have become cheaper and more abundant, largely due to the development of cheap Large Scale Integrated circuits. These calculators are designed with a low power consumption compatible with battery power supplies. This design parameter has dictated that the calculators use low power readout devices, such as light emitting diodes, liquid crystal displays, and the like.

One feature of hand-held calculators which has been keenly lacking is a means of printing the calculator readout directly onto paper. This shortcoming is due to the power requirements of state of the art digital printing devices which are too large to be supported by the typical battery power supply. Since the calculator functions virtually without error, it is ironic that the greatest source of error is in mistakes in number input, and in manually transcribing the digital light display onto paper. A digital printout device compatible in size and power requirements with a hand-held calculator would aid significantly in reducing errors. Furthermore, the manual transcription process takes much more time than the milliseconds required for the actual calculation. A hand-held calculator with a printout capability would be many times faster than present devices.

SUMMARY OF THE INVENTION

The present invention comprises a low power digital printout device which is adapted to be employed in a hand-held calculator. The low power requirement of the device is made possible by a unique printing arrangement in which all motive power and printing pressure is furnished manually. The calculator coded readout signal serves only to enable the appropriate digit segments to be imprinted, forming a hard copy of the correct indicia.

The digital printout device generally comprises a first rectangular block formed of an elastic material. Embedded in this block are a plurality of indicia forming bar segments arranged vertically in any convenient pattern, such as the commonly known seven bar digit configuration. Each segment extends the full height of the block, and includes a raised anvil portion protruding from the top of the block. Joined to the top of the first block by a resilient adhesive layer is a rigid upper block of similar dimensions.

Embedded in the upper block is an array of needle electromagnets, each electromagnet aligned vertically with one indicia forming segment. The leads of the electromagnets are connected to a standard pin socket or the like joined to one side of the upper block. Disposed between each electromagnet and the anvil of its associated bar segment is a sloping channel extending from the lower portion of the upper block into the adhesive layer. Within each channel is a ferromagnetic actuator which freely slides in the channel.

The blocks are arranged so that manual pressure on the upper block is transmitted through each actuator to the anvil of its respective indicia forming segment. This pressure causes the lower end of the segment to protrude from the elastic lower block and imprint upon a pressure sensitive printing surface. If the actuator is not disposed in the printing position between its electromagnet and anvil, the segment will not be forced into the protruding printing position.

The needle electromagnets serve to selectively latch the appropriate actuators in their printing positions, thus determining which segments will imprint. The block assembly is mounted on a compound lever device or the like which causes the assembly to tilt as it is manually forced downward toward the printing surface. This tilting action causes the unlatched actuators to slide out of their printing position, so that only the selected indicia forming segments actually imprint. The selection of the appropriate segments is provided by the digitally coded output of the calculator which is connected to the printout device through the pin socket.

THE DRAWING

DESCRIPTION OF THE PREFERRED EMBODIMENT

Figure 1:
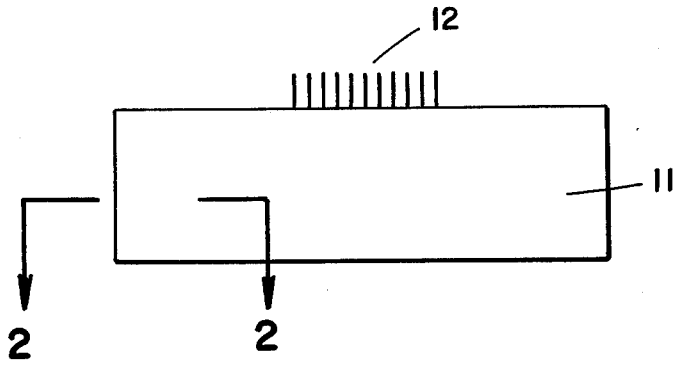
FIG. 1 is a top view of the printout device of the present invention.
Figure 2:
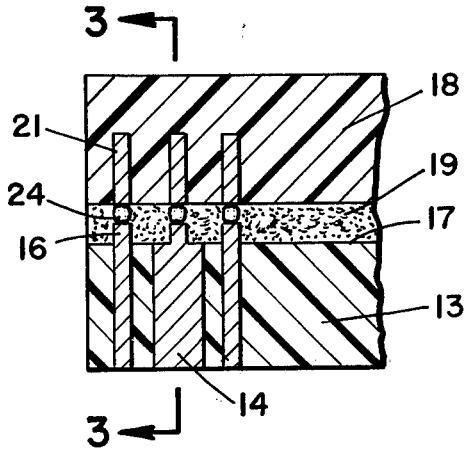
FIG. 2 is a cross-sectional elevation taken along line 2—2 of FIG. 1.
Figure 3:
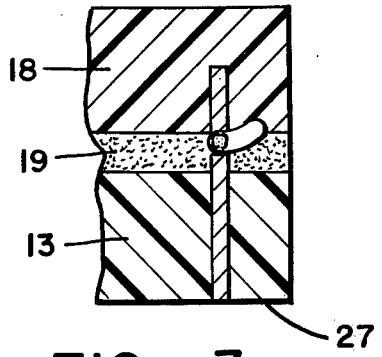
FIG. 3 is a cross-sectional elevation taken along line 3—3 of FIG. 2.

As shown in FIG. 1 the present invention generally comprised a digital printout device 11 having a rectangular solid appearance, and provided with a standard pin connector 12 to interface through a flexible conductor with the coded output stage of a digital calculator or the like. With reference to FIG. 2, the printout device includes a lower rectangular block 13 formed of a resilient elastic material. Embedded in the lower block is a plurality of indicia forming printing segments 14, each aligned vertically and extending the entire height of the lower block. The segments each comprise, in the preferred embodiment, a flat bar having a raised anvil 16 extending approximately 3 mm. from the upper end thereof, and also extending above the upper surface 17 of the lower block. The segments are arrayed in the commonly known seven bar pattern which is capable of forming most alphanumeric characters.

Disposed vertically above the block 13 is a rigid upper block 18 joined to the lower block by a layer of elastic adhesive 19. In the upper block there are embedded a plurality of needle electromagnets 21 arrayed in the same manner with each electromagnet disposed directly above the anvil portion of its respective indicia forming segment. The leads from the electromagnets extend through the upper block to the pin connector 12, which is also anchored in the upper block.

Figure 4:
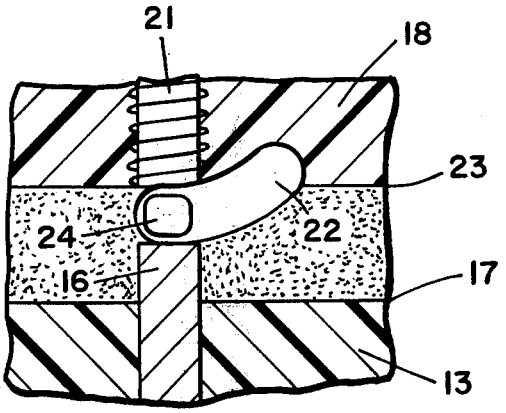
FIG. 4 is an expanded view of a portion of the printout device of the present invention.

Interposed between each electromagnet and the anvil of its associated printing segment is a channel 22 which extends from the adhesive layer sloping upwardly into the lower surface 23 of the upper block. Disposed within each channel is an actuator 24, which comprises a small ferromagnetic slug of irregular but generally oval configuration. The actuator is adapted to slide or roll freely within the channel, as shown in FIG. 4. Each actuator is normally in repose directly between the needle electromagnet and the anvil of the respective printing segment in position to transmit force from the upper block to the anvil of the printing segment.

Figure 5:
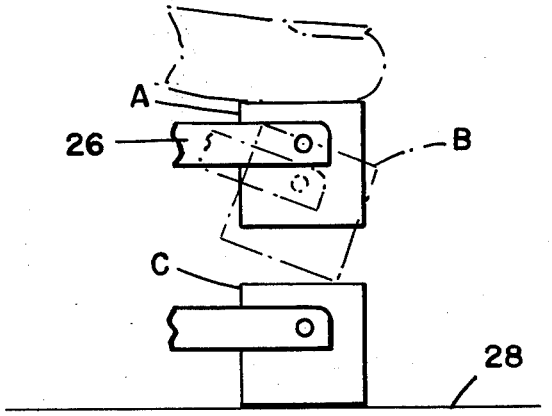
FIG. 5 is a sequential operational drawing of the operation of the present invention.

In operation the coded signals are sent to selected electromagnets to form the appropriate digital printout. The electromagnets latch their respective ferromagnetic actuators in the normal, force transmitting position. Those actuators not so latched are still free to slide within their channels 22. Imprinting is effected manually by urging the device 11 downwardly (FIG. 5). The device is supported on a compound lever assembly 26 or the like which causes the device to tilt forward (B) as it descends. The unlatched actuators are forced by the tilting action to slide to the upper end of the channel, out of possible engagement between the needle electromagnet and the anvil.

The manual pressure is transmitted from the rigid upper block 18 through the latched actuators to their respective indicia forming segments. The pressure causes these segments to deform the elastic lower block and to extend below the lower surface 27 thereof. As the device descends to the printing surface 28 (C) the segments extending below the surface 27 strike the surface 28 and imprint the proper indicia thereon. The unlatched actuators do not transmit any force and those segments do not imprint.

As the device returns upward to the rest position the needle electromagnets are deactivated and all of the actuators return to the position shown in FIG. 4. It should be noted that little electrical power is consumed, since the electromagnets need move nothing. All of the printing force and motion is provided through manual means. The present invention is sufficiently small to be secured directly to a hand-held calculator, but may be advantageously employed with other devices, such as automatic price marking tools, typewriters, or the like.

I claim:

1. A printing apparatus comprising a first, elastic member having a plurality of indicia forming segments embedded therein; a second, rigid member joined to said first member with an elastomeric layer interposed therebetween; a plurality of electromagnets embedded in said second member, each aligned with one of said indicia forming segments, actuator means disposed between each of said electromagnets and each of said indicia forming segments, said actuator means including a plurality of channels, each channel disposed between one of said electromagnets and the respective indicia forming segment, and a ferromagnetic actuator freely disposed within each of said channels to be selectively latched by the activation of the respective electromagnet in a force transferring position between said second member and said indicia forming segment for subsequent printing.

2. The printing apparatus of claim 1, wherein each of said indicia forming segments includes a raised anvil area extending into said elastomeric layer.

3. The printing apparatus of claim 1, wherein said channel extends in sloping fashion from said elastomeric layer into said second rigid member.

4. The printing apparatus of claim 1, including means for translating said apparatus and urging one surface of said first member downward onto a printing surface.

5. The printing apparatus of claim 4, wherein said last mentioned means includes means for tilting said apparatus as it is urged downward.

* * * * *